US008622030B2

(12) United States Patent
Lovato

(10) Patent No.: US 8,622,030 B2
(45) Date of Patent: Jan. 7, 2014

(54) SPIRAL HEAT EXCHANGER FOR PRODUCING HEATING AND/OR SANITARY USE HOT WATER, SPECIFICALLY DESIGNED FOR CONDENSATION APPLICATIONS

(75) Inventor: Giandomenico Lovato, San Bonifacio (IT)

(73) Assignee: Ferroli S.p.A., San Bonifacio (VR) (IT)

( * ) Notice: Subject to any disclaimer, the term of this patent is extended or adjusted under 35 U.S.C. 154(b) by 1069 days.

(21) Appl. No.: 12/592,819

(22) Filed: Dec. 3, 2009

(65) Prior Publication Data

US 2010/0170665 A1 Jul. 8, 2010

(30) Foreign Application Priority Data

Dec. 16, 2008 (IT) ..... MI08A2232

(51) Int. Cl.
*F28F 13/00* (2006.01)

(52) U.S. Cl.
USPC ..... 122/235.23; 122/249; 122/251; 165/147; 165/156; 165/184

(58) Field of Classification Search
USPC ..... 122/235.11, 235.23, 247, 249, 18.1, 122/251, 408.1; 165/177, 184, 156, 146, 165/147
See application file for complete search history.

(56) References Cited

U.S. PATENT DOCUMENTS

| | | | | |
|---|---|---|---|---|
| 1,569,499 | A * | 1/1926 | Kagi | 165/156 |
| 2,566,976 | A * | 9/1951 | Bernstrom | 165/75 |
| 4,424,624 | A * | 1/1984 | Sievers | 29/727 |
| 4,540,045 | A * | 9/1985 | Molitor | 165/164 |
| 4,567,943 | A * | 2/1986 | Longsworth et al. | 165/147 |
| 4,645,645 | A * | 2/1987 | Martinez et al. | 422/46 |
| 5,339,654 | A * | 8/1994 | Cook et al. | 62/476 |
| 5,409,057 | A * | 4/1995 | Zifferer | 165/156 |
| 5,533,362 | A * | 7/1996 | Cook et al. | 62/476 |
| 6,152,086 | A * | 11/2000 | Brouwer et al. | 122/249 |
| 7,367,380 | B2 * | 5/2008 | Lee et al. | 165/67 |
| 2007/0125528 | A1 * | 6/2007 | Fakheri | 165/163 |
| 2007/0209606 | A1 * | 9/2007 | Hamada et al. | 122/18.1 |
| 2007/0289559 | A1 * | 12/2007 | Amada | 122/19.2 |
| 2009/0025399 | A1 * | 1/2009 | Kamen et al. | 62/6 |

* cited by examiner

*Primary Examiner* — Gregory A Wilson
(74) *Attorney, Agent, or Firm* — Hedman & Costigan, P.C.; James V. Costigan; Kathleen A. Costigan

(57) ABSTRACT

A spiral heat exchanger for producing heating and/or sanitary use hot water, specifically designed for condensation applications, characterized in that said spiral heat exchanger comprises a duct, preferably though not exclusively made of a thermally conductive material and having a contoured cross-section, called outer duct, inside which can be either arranged or not a second duct, preferably though not exclusive made of a thermally conductive material, called inner duct; the geometrical construction of said outer duct being defined as a resultant obtained by joining two different diameter circumferences, said circumferences being spaced from one another by a constant or variable radius junction pattern; the thus obtained single or double duct being coiled or spiral wound on a diameter substantially larger than the size of said duct thereby providing a hollow cylinder.

3 Claims, 9 Drawing Sheets

SPIRAL HEAT EXCHANGER FOR PRODUCING HEATING AND/OR SANITARY USE HOT WATER, SPECIFICALLY DESIGNED FOR CONDENSATION APPLICATIONS

BACKGROUND OF THE INVENTION

The present invention relates to a heat exchanger designed for transmitting heat from a primary gaseous fluid to a secondary liquid fluid.

More specifically, the heat exchanger according to the present invention is particularly, though not exclusively, adapted for heating and/or sanitary hot water producing systems, and has been specifically designation for condensation applications.

SUMMARY OF THE INVENTION

The main object of the present invention is to provide a heat exchanger of the above mentioned type which is improved with respect to prior like heat exchangers.

Another object of the present invention is to provide such a heat exchanger construction which is very reliable and safe in operation.

According to one aspect of the present invention, the above mentioned objects, as well as yet other objects, which will become more apparent hereinafter, are achieved by a spiral heat exchanger for producing heating and/or sanitary use hot water and which is particularly suitable for condensation applications, said heat exchanger comprising a heat exchanging means comprising a spiral duct, having a shaped or contoured cross section, in which a second circular duct is built-in.

BRIEF DESCRIPTION OF THE DRAWINGS

Further characteristics and advantages of the present invention will become more apparent hereinafter from the following detailed disclosure of a prefer-red, though not exclusive, embodiment of the invention, which is illustrated, by way of an indicative, but not limitative, example in the accompanying drawings, where.

DESCRIPTION OF THE PREFERRED EMBODIMENTS

Figure 1:
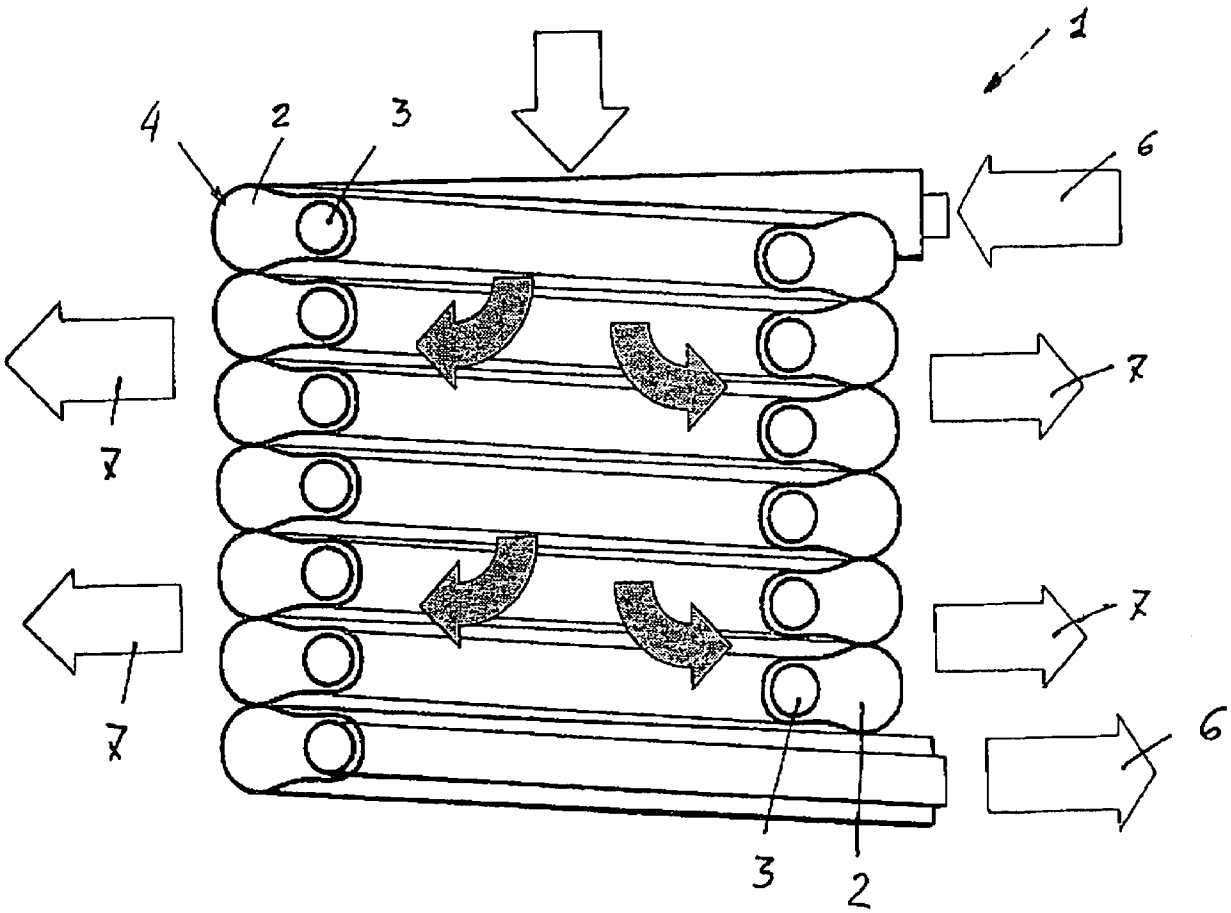
FIG. 1 is an elevation view showing the heat exchanger construction according to the present invention.
Figure 2:
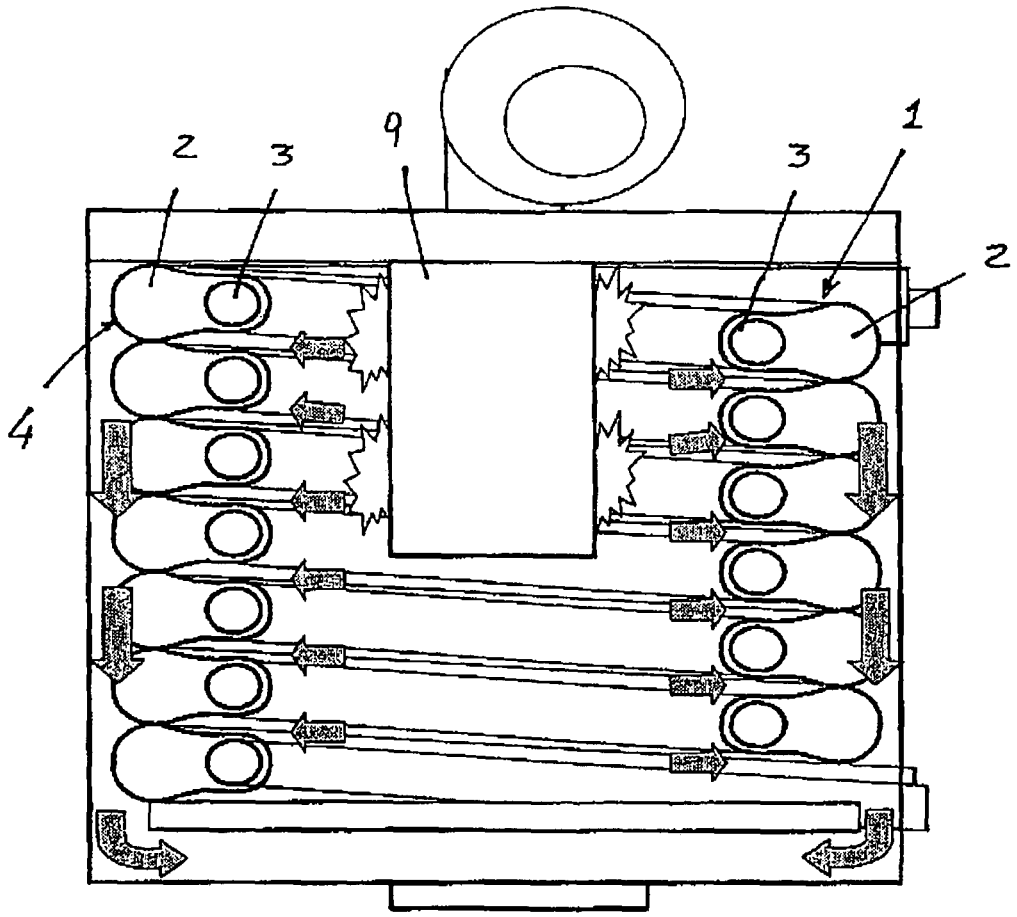
FIG. 2 is a further elevation view of the heat exchanger construction comprising a heat exchanger cylinder in which are arranged one or more pre-mixed, blown, catalytic burners for burning gaseous, solid and liquid fuels, the heat exchanger further including a burning chamber with burning chamber walls directly cooled or refrigerated by the secondary fluid.
Figure 3:
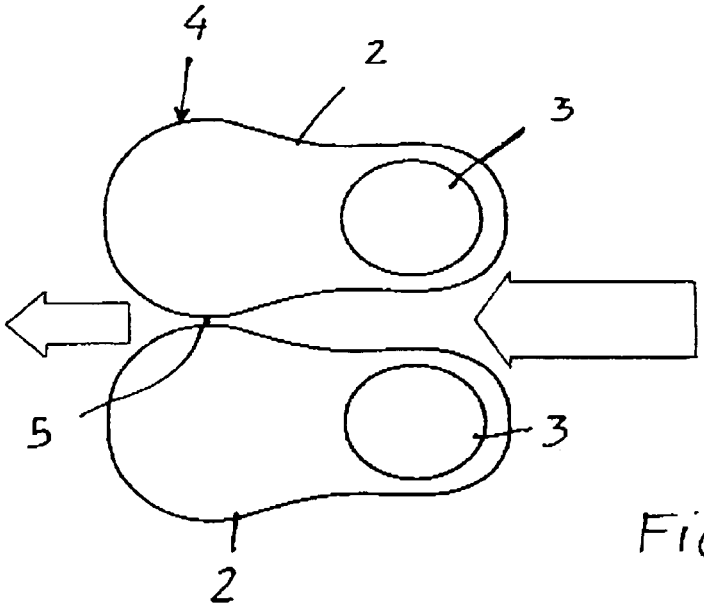
FIG. 3 is a cross-sectional view of two adjoining turns or coils of the heat exchanger construction according to the present invention.

With reference to the number references of the above mentioned figures, the spiral heat exchanger according to the invention, which has been generally indicated by the reference number 1, comprises an outer duct 2 preferably though not exclusively made of a thermally conductive material and having a contoured or shaped cross-section, in which may be arranged a second inner duct 3, also preferably, though not exclusively, made of a thermally conductive material.

Advantageously the outer duct 2 has a combined pear shape configuration defined by two adjoining coupled circumferences of respective radii R1 and R2, arranged at a distance D, this novel and inventive pear shape allowing the inventive heat exchanger to highly efficiently operate, since the heat exchanger, being devoid of flat surfaces, will provide an improved thermal exchange between the primary and secondary fluids contacting the heat exchanger itself.

As shown, the inner duct 3 has, preferably though not exclusively, a circular or an elliptical or a polygonal cross-section and provides with the outer duct 2 either "double" spiral configuration duct arrangement 4 having a diameter substantially larger than that of each single duct, thereby substantially providing a hollow cylinder.

On the outer duct 2 are formed at equal spacings, preferably with a constant pitch, for example by pressing, a plurality of bosses forming on the outer duct a plurality of inward directed indentations or cavities 10, thereby slightly spacing the spiral coils by a constant spacing gap 5 substantially less than the coil pitch, to also greatly improve the heat exchanger, since said bosses increase the turbulence of the secondary fluid circulating through the heat exchanger duct or cylinder arrangement.

In fact, in operation, through said "double" duct construction, providing two different characteristic circuits of two different secondary fluids 6, for example heating water or sanitary water are conveyed, wherein the primary fluid 7, which is a high temperature gaseous fluid, is expanded in said hollow cylinder, thereby flowing to the outside through the coil gaps 5, while giving its heat to the secondary fluids 6 circulating in the heat exchanger ducts.

Advantageously, in said cylinder are further arranged one or more premixed burners 9, either of a blown or catalytic type, for gaseous, solid and liquid fuels, operating as a heat exchanging burning chamber having burning chamber walls directly refrigerated by the secondary fluids 6, thereby preventing polluting thermal NOx from being generated in the burning process.

Moreover, since the subject heat exchanger arranged in an enclosing envelope, preferably though not exclusively made of a metal material, and having preferably a circular base cylindric configuration, said heat exchange provides a heat generator which can also operate based on a condensation principle.

In fact, by arranging a plurality of inner separating elements 15 in the hollow cylinder, it is possible to suitably deviate the primary fluid, thereby greatly improving the operating efficiencies of the heat exchanger.

As stated, another novel feature of the heat exchanger construction according to the invention is that the adjoining spiral coils do not have parallel flat faces, and the coil gaps are arranged with a non constant arrangement, but with a pattern arrangement decreasing in the primary fluid conveying direction.

Figure 11:
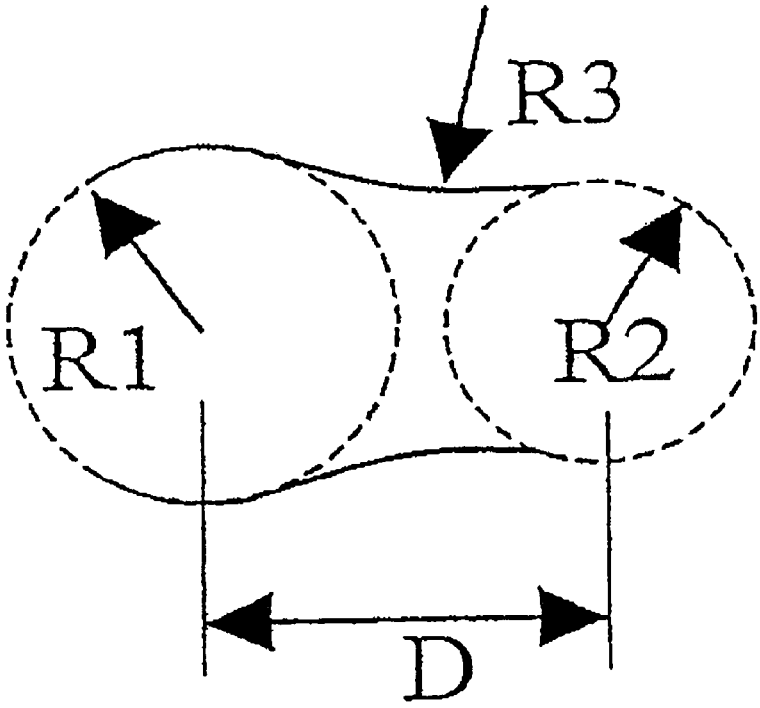
FIG. 11 shows the geometrical construction of the outer duct.

As further stated, the geometrical construction of the outer duct, in particular, can be considered as a combined construction achieved by coupling two circumferences having a respective radius R1 and R2, arranged at a spacing D, and coupled by a coupling arrangement having either a constant or variable radius R3, which is better shown in FIG. 11.

Figure 4:
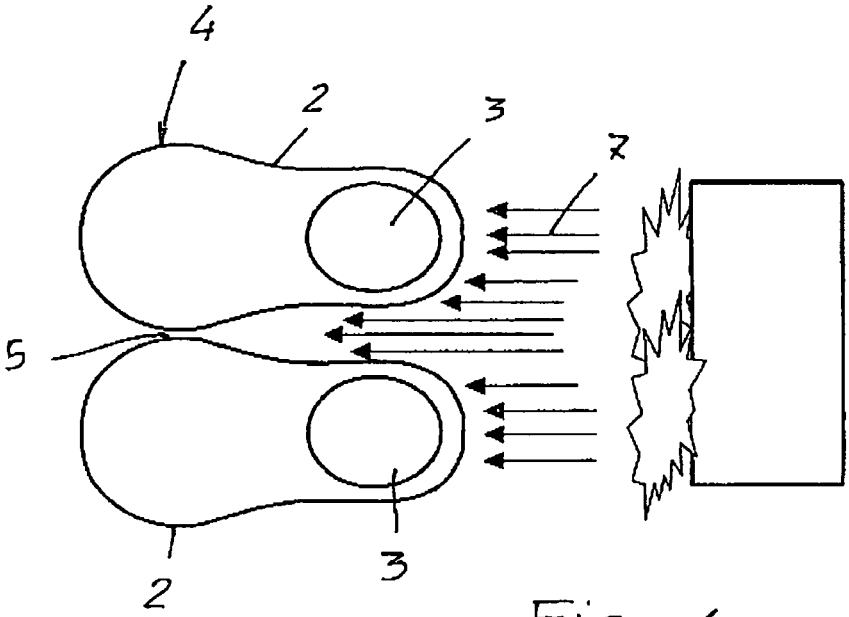
FIG. 4 is a schematic operating diagram showing that the primary gaseous fluid has a starting high volume and temperature and, upon passing through the spiral coils, a decreased volume, decreasing according to the Boyle's Law.
Figure 5:
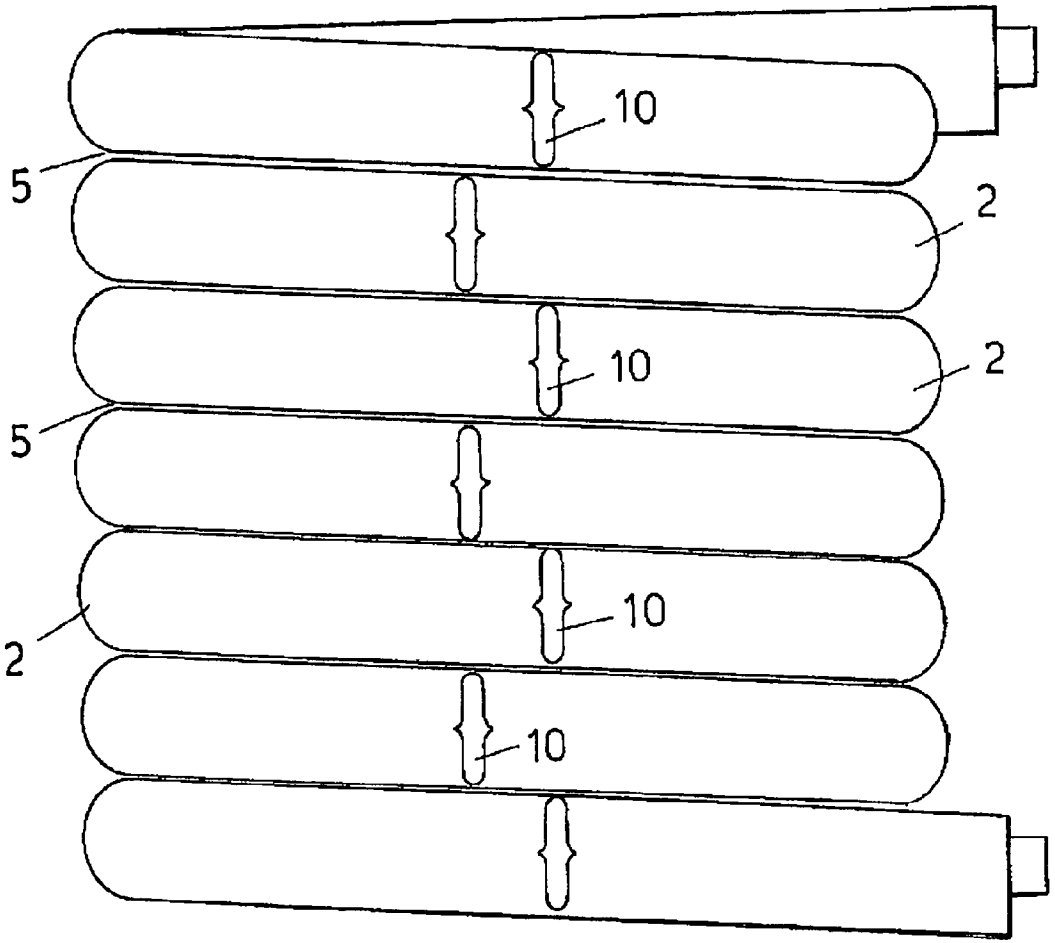
FIG. 5 is a side view of the spiral heat exchanger according to the present invention comprising a plurality of spiral coils and corresponding spaced bosses slightly spacing said oils by a constant gap from one another.
Figure 6:
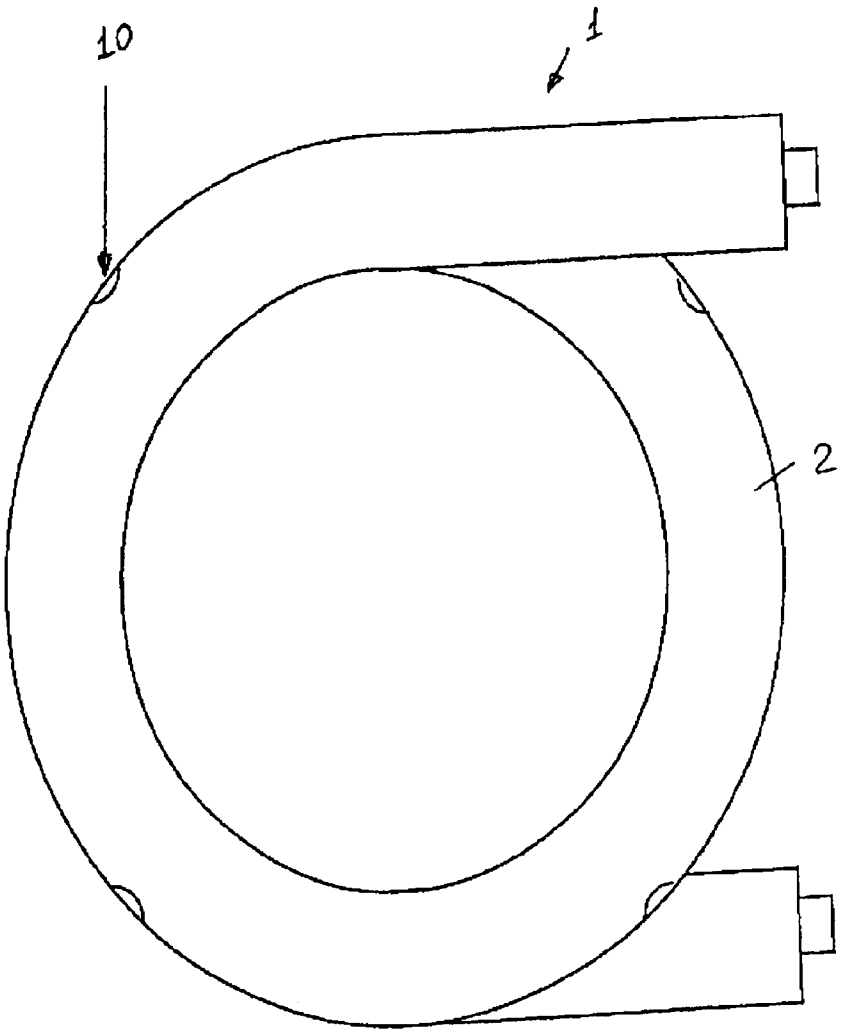
FIG. 6 is a view orthogonal to FIG. 5, further showing the spiral heat exchanger according to the present invention including a series of bossed spiral coils.
Figure 7:
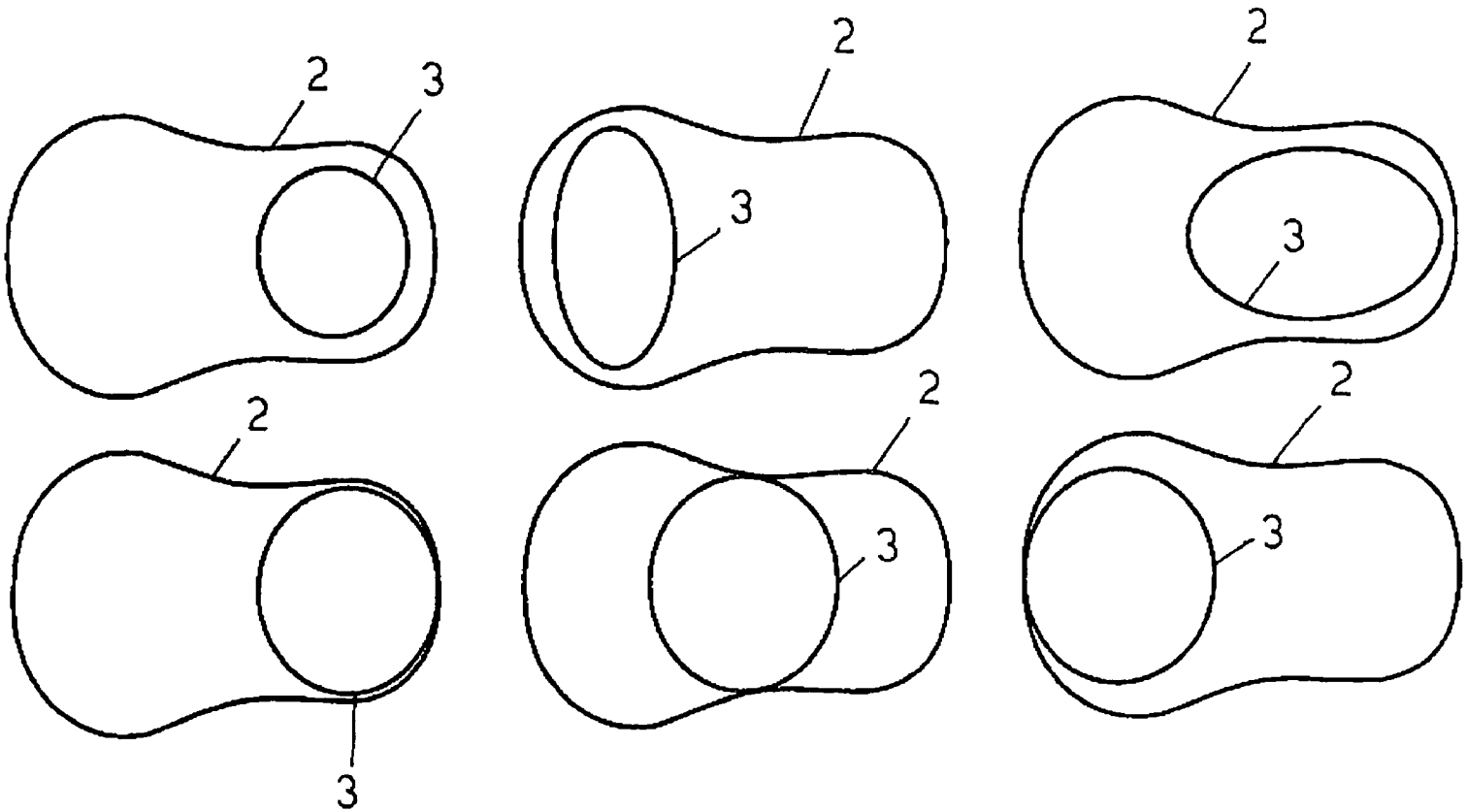
FIG. 7 is a further cross-sectional view showing an outer and an inner duct, said inner duct having a circular, elliptical or polygonal cross-section and being arranged at different positions with respect to the outer duct, in particular, being so arranged within said outer duct to provide an improved operation efficiency.
Figure 8:
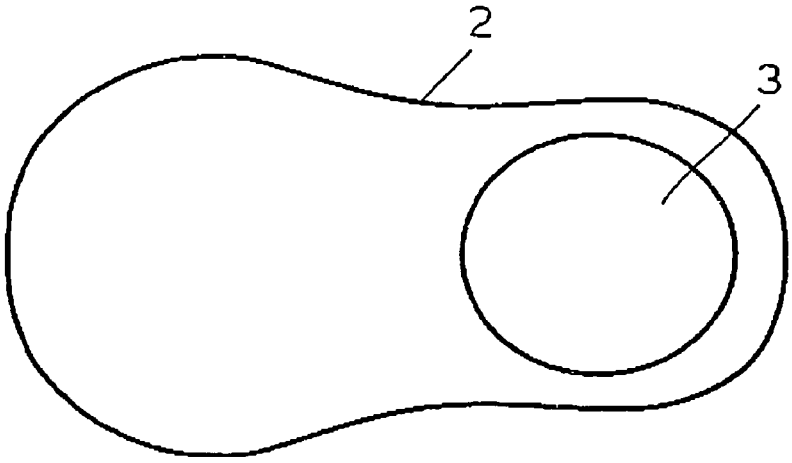
FIG. 8 shows a cross-sectional view of a coil of the heat exchanger according to the present invention, said coil comprising a circular outer duct and inner duct.
Figure 9:
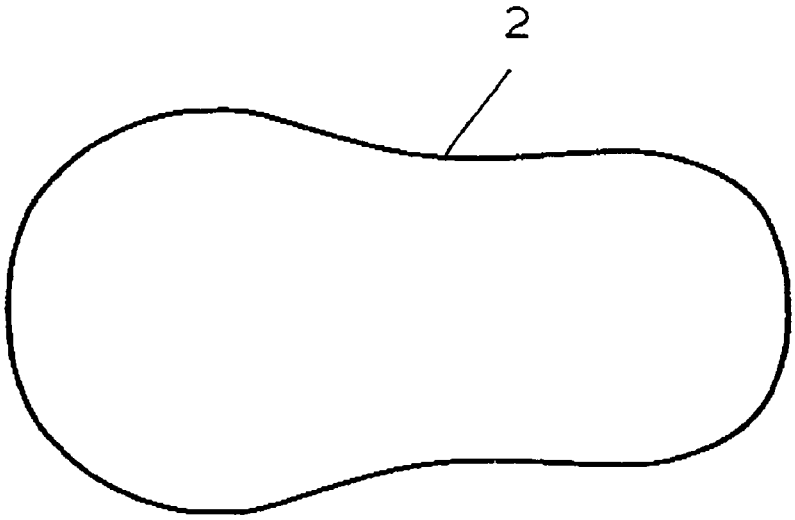
FIG. 9 shows a coil of the spiral heat exchanger according to the present invention, without the inner duct.
Figure 10:
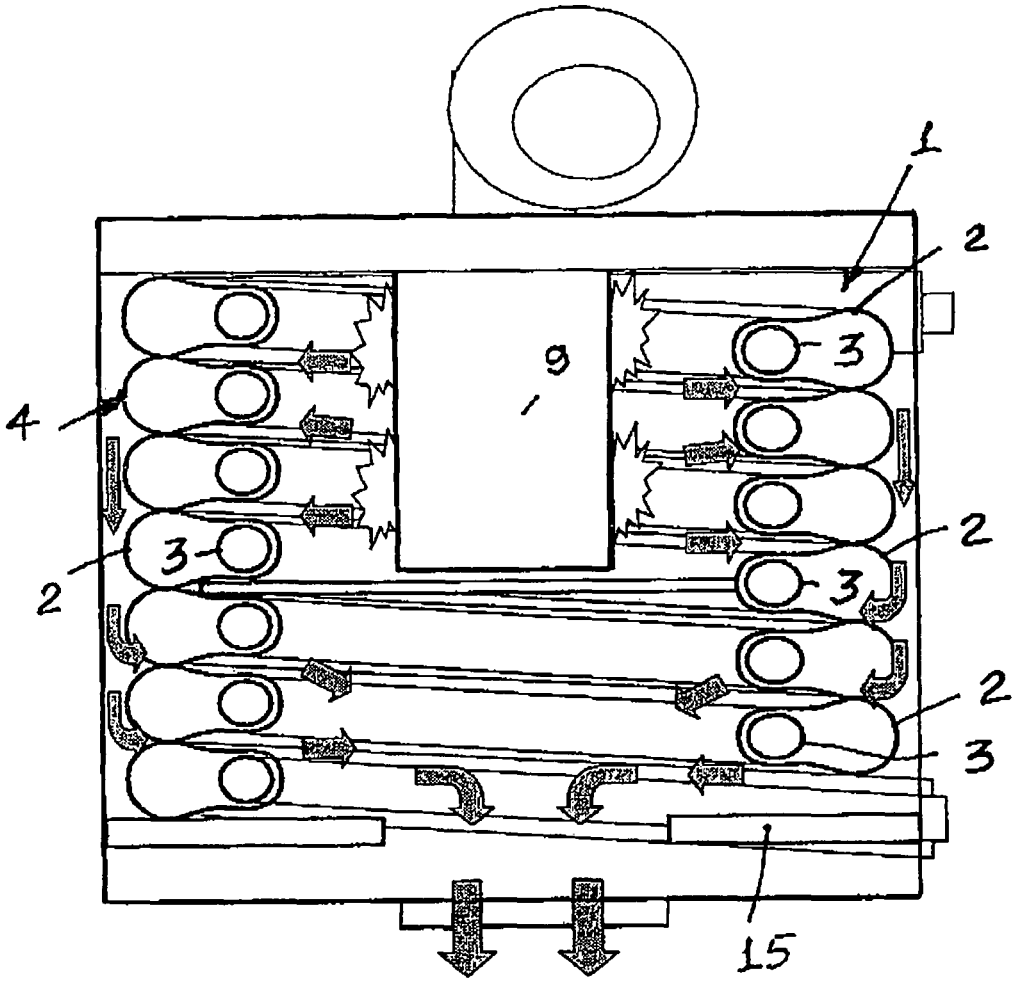
FIG. 10 shows a heat exchanger so constructed that, by arranging inner separating elements in the heat exchanger hollow cylinder, it is possible to offset the path of the primary fluid, thereby providing a very efficiently operating heat exchanger.

Thus, the possibility of achieving a thermal exchange between a first gaseous fluid and a second liquid fluid, while providing a high turbulence of the second fluid, a high contact surface, and efficient thermal radiation exchange, and the possibility of directly arranging at the top of the heat exchanger body a burner, make the inventive heat exchanger suitable to operate with boilers preferably though not exclusively designed for producing heating and/or sanitary hot water, the gaseous status primary fluid having a starting very high volume and temperature, as is shown on the right part of FIG. 4, and, in passing through the spiral coils, releasing its thermal energy thereby reducing its volume, according to the Boyle's Law, even if such a volume reduction could cause a lowering of the fluid pressure, with a consequent deterioration of the thermal exchange.

In actual practice this does not occur since the heat exchanger narrowing cross-section allows the primary fluid to be always held at a pressure suitable for greatly improving the thermal exchange.

Finally, the above disclosed configuration of the outer duct provides a further important advantage, since the inner sides of the spiral coils are directly facing one another on the burner 9 thereby the surface exposed to the radiation heat transmission will be a very large one, thereby providing a high efficiency heat exchanger, which may be easily made of different materials such as stainless steel, common steel, copper, aluminium, and plastics materials.

Moreover the provision of said inner separating elements 15 allows to properly deviate the primary fluid thereby optimizing the heat exchanger operation, as a conventional heat source, or a condensation, power heat exchanger.

As stated, one of the main features of the spiral heat exchanger 1 according to the present invention is that its adjoining spiral coils 2 do not have parallel flat faces, and the gap between adjoining coils is a non constant gap decreasing in the conveying direction of the primary fluid.

This feature will greatly favor the flow of the primary fluid through the heat exchanger 1, while greatly improving the thermal exchange, since, as stated, said primary gaseous fluid has, at a starting condition thereof (see the right side of FIG. 4), a high volume and temperature and, as it is conveyed through the spiral coils, it will release its heat thereby reducing its volume.

Moreover, the narrowing of the fluid passage cross-sections allows the primary fluid to be held at a proper pressure, thereby greatly improving, as stated, the thermal exchange efficiency.

It has been found that the invention fully achieves the intended aim and objects.

In fact, the invention provides a heat exchanger to be used as a thermal source or generator for heating systems and/or hot and sanitary water producing systems having an improved thermal exchange between a gaseous fluid and a liquid fluid or fluids since the heat exchanger provides a very high turbulence of said liquid fluid, a high contact surface, an efficient thermal radiation exchange, with the possibility of directly integrating into the top of the heat exchanger body a burner.

In practicing the invention, the used materials, as well as the contingent size and shapes, can be any, depending on requirements.

The invention claimed is:

1. A spiral heat exchanger enclosed in a metal shell having a circular cylindric bottom for producing heating hot water, sanitary hot water or heating hot water for condensation applications, said spiral heat exchanger comprising a first thermally conductive material outer duct having a pear outer contour, a secondary fluid being caused to flow inside said first outer duct to provide two circulating circuits with different characteristics and through one of said circulating circuits heating water being conveyed and through the outer of said circulating circuits sanitary water being conveyed, a second thermally conductive material inner duct arranged in said outer duct, said inner duct having a circular shape or elliptic shape or polygonal shape or other cross sectional shape, said pear outer contour of said first outer duct being defined by joining two circumferences of different diameters, said circumferences being spaced from one another by a constant or variable radius junction contour portion, said first and second ducts being spiral wound on a diameter substantially larger than a size of said outer duct thereby providing a hollow cylinder, characterized in that a primary fluid is caused to expand within said hollow cylinder, to achieve a gaseous status at a high temperature, said primary fluid then flowing to the outside through gaps between said spiral coil turns, thereby releasing heat to the secondary fluid or secondary fluids circulating inside said ducts.

2. A spiral heat exchanger, according to claim 1, characterized in that said heat exchanger allows to directly build inside said hollow cylinder one or more burners of a premixed, blown, catalytic type for gaseous, solid and liquid fuels, thereby said heat exchanger also provides a combustion chamber function, said combustion chamber having combustion chamber walls directly cooled by the secondary fluid.

3. A spiral heat exchanger, according to claim 1, characterized in that as said heat exchanger is used as a heat generator, inner sides of said spiral coil turns are arranged directly facing a burner arranged in said heat exchanger.

* * * * *